US007666054B2

(12) United States Patent
Glickman et al.

(10) Patent No.: US 7,666,054 B2
(45) Date of Patent: Feb. 23, 2010

(54) OFFSET MATRIX ADAPTER FOR TOY CONSTRUCTION SETS

(75) Inventors: Joel I. Glickman, Jupiter, FL (US); Matthias F. W. Doepner, Harleysville, PA (US)

(73) Assignee: K'NEX Limited Partnership Group, Hatfield, PA (US)

( * ) Notice: Subject to any disclaimer, the term of this patent is extended or adjusted under 35 U.S.C. 154(b) by 523 days.

(21) Appl. No.: 11/582,024

(22) Filed: Oct. 16, 2006

(65) Prior Publication Data

US 2008/0090485 A1 Apr. 17, 2008

(51) Int. Cl.
*A63H 33/08* (2006.01)

(52) U.S. Cl. ..... 446/124; 446/85; 446/120

(58) Field of Classification Search ..... 446/85, 446/118–122, 124–128
See application file for complete search history.

(56) References Cited

U.S. PATENT DOCUMENTS

| | | | | | |
|---|---|---|---|---|---|
| 2,683,329 | A * | 7/1954 | Kobler | 446/122 |
| 3,469,339 | A * | 9/1969 | Thomas | 446/122 |
| 4,744,780 | A * | 5/1988 | Volpe | 446/128 |
| 5,061,219 | A * | 10/1991 | Glickman | 446/126 |
| 5,199,919 | A * | 4/1993 | Glickman | 446/126 |
| 5,238,438 | A * | 8/1993 | Glickman | 446/126 |
| 5,350,331 | A * | 9/1994 | Glickman | 446/126 |
| 5,683,283 | A * | 11/1997 | Glynn | 446/128 |
| 5,964,635 | A * | 10/1999 | Krog | 446/120 |
| 6,398,612 | B2 * | 6/2002 | Gudger | 446/125 |
| 6,676,474 | B2 * | 1/2004 | Glickman | 446/126 |
| 6,736,691 | B1 * | 5/2004 | Bach | 446/128 |
| 6,843,700 | B2 * | 1/2005 | Glickman | 446/127 |

* cited by examiner

*Primary Examiner*—Gene Kim
*Assistant Examiner*—Scott Young
(74) *Attorney, Agent, or Firm*—St. Onge Steward Johnston & Reens LLC

(57) ABSTRACT

An offset matrix adapter for integrating existing components of K'nex construction toys with existing components of Lego-style brick systems, notwithstanding that the spacing matrices of the systems are incompatible. Adapter bricks or bases are provided, having adapter sockets with the same spacing matrix as the studs of the Lego-style bricks. Special K'nex offset matrix adapters are provided, consisting of a pair of spaced-apart mounting stems for reception in a pair of spaced-apart adapter sockets. An offset rod is rigidly supported at the tops of the mounting stems but is offset laterally from the axes of the mounting stems by a distance which is preferably about one-third of the spacing between adapter sockets. By orienting a pair of matrix adapters with the rods offset alternatively inward or outward, the spacing differences between K'nex and Lego-style systems can be reduced to insignificance, allowing the two systems to be easily integrated.

8 Claims, 10 Drawing Sheets

OFFSET MATRIX ADAPTER FOR TOY CONSTRUCTION SETS

RELATED APPLICATIONS

This application is related generally to U.S. application Ser. No. 11/146,971, filed Jun. 7, 2005, now U.S. Pat. No. 7,267,598, granted Sep. 11, 2007.

BACKGROUND OF INVENTION

The above mentioned copending application is directed to concepts for integrating the well known K'nex rod and connector construction toy system with brick style construction toy systems, such as Lego and Mega Bloks, for example. Techniques described in the copending application for this purpose involve, among other things, special sizing of the K'nex rod and connector elements for universal compatibility with the well known brick-type construction toy systems, which utilize bricks of standard sizes. The existing brick-type systems are based upon standardized lateral and longitudinal spacing of studs, which project upward from the brick elements and enable such elements to be frictionally connected with similar brick elements positioned directly above. In the system of the above described copending application, special adapter bricks are provided, dimensioned to correspond with existing bricks and which include uniformly spaced vertical sockets, positioned between sets of studs, for receiving special adapter pins. The adapter pins include upwardly projecting end portions configured to engage with connector elements of the K'nex system. The arrangement is such that the K'nex rods and connectors may be joined with brick assemblies at points spaced longitudinally, transversely or diagonally, to accommodate complex integration of K'nex and brick-type structures.

Whereas the above described arrangement for integrating K'nex and brick-type construction toy systems is highly advantageous and useful, it does not easily accommodate the use of the substantial base of existing sizes of K'nex rod and connector elements, with the existing base of Lego-type bricks. The existing K'nex rods and connectors were initially sized without any reference to common brick-type construction sets and are thus dimensionally incompatible with the spacing intervals employed in the common brick-type systems. In general, the use of standard elements of one system has required the elements of the other system to be redimensioned for full compatibility.

SUMMARY OF THE INVENTION

In accordance with the present invention, the structural integration of the existing K'nex components with existing, standard-sized brick-type components can be accomplished through the use of special offset matrix adapter elements, which are engageable with brick system components having a standard stud spacing and otherwise being fully dimensionally compatible with Lego and similar systems. The system of the invention includes Lego-compatible bricks or panels which have been provided between pairs of studs with vertically opening adapter sockets for receiving adapter elements. These sockets are formed in bricks or panels that otherwise dimensionally correspond to standard Lego-type systems, and the adapter sockets are provided within these dimensional limitations so as to not compromise in any way the total compatibility of the adapter brick or panel elements with otherwise fully conventional, standard-size Lego-type elements.

In a standard size Lego-type system, the studs are spaced apart longitudinally and transversely by a distance of approximately 0.315 inch (8.0 mm). The adapter sockets provided in the adapter panels or bricks are, in accordance with the present invention, spaced uniformly, centered among a group of four studs, and thus are also spaced apart with a standardized spacing of 0.315 inch (8.0 mm). In a solid panel, this 0.315 inch (8.0 mm) spacing would exist both longitudinally and transversely, preferably over the entire area of the panel. In a side-by-side assembly of bricks, the surface area presented of the brick assembly is interrupted by joints between adjacent, contacting bricks. Wherever there is a joint between adjacent bricks, there typically is no adapter socket, so there will be interruptions in the spacing of adapter sockets over the surface of an assembly made up of a plurality of bricks joined side wall to side wall. However, the spacing matrix remains the same, in that the length and width dimensioning of the bricks is such that, adjacent adapter sockets in a pair of adjacent bricks are simply spaced apart by twice the usual 0.315 inch (8.0 mm) spacing. The overall spacing matrix remains consistent throughout the entire assembly of bricks, notwithstanding the absence of sockets in locations where bricks are joined side wall to side wall.

The K'nex rod and connector system comprises a plurality of hub and spoke-type connector elements and a plurality of rods of measured lengths. The connector elements are formed with a central hub and one or more rod-engaging sockets extending radially from the hub. The base of the socket is, in all cases, a fixed distance from the central axis of the hub. The basic principles of the K'nex system are set forth in the Glickman U.S. Pat. Nos. 5,061,219 and 5,199,919, the disclosures of which are incorporated herein by reference. As disclosed in said patents, the lengths of the rods follow a progression according to the formula $2D+L_x=0.707*(2D+L_{x+1})$, where D equals the distance from the center axis of a connector to the base of its sockets, and L equals the length of a rod. In a typical building set, there is a progression of rod lengths from minimum to maximum, all dimensioned according to the foregoing formula.

Currently, K'nex sets are marketed in two principal sizes, "Classic", which is the larger of the two, and "Micro", which is smaller. In a "Classic" K'nex set, the rod lengths may be provided in a progression ranging from approximately 0.61 inch (15.49 mm) to approximately 7.560 inches (192 mm), according to the foregoing progression. For a typical "Micro" set, the component parts are smaller in all respects, and the rod length progression may extend over a range from about 0.5625 (14.29 mm), for the shortest rod, to about 7.874 inches (200 mm) for the longest rod. Typically, all the dimensions of the "Micro" set are scaled down as compared to the components of the "Classic" set. For example, as the diameter of the rods of the "Classic" set may be approximately one-quarter inch, those of the "Micro" set may be approximately 0.152 inch (3.86 mm). The distance $D_m$ from the hub axes to the socket base of a Micro-size connector, is 0.241 inch (6.12 mm), whereas the distance $D_c$ for the "Classic" set is 0.398 inch (10.1 mm).

Inasmuch as the K'nex rod and connector systems were designed and developed without reference to the Lego-type brick construction systems, there is no inherent compatibility between the two to enable the two systems to be integrated in a way to enable complex structures to be assembled utilizing components of both systems to form unique and advantageous hybrid structures.

Pursuant to the invention, special matrix adapters are provided, which can be assembled with the beforementioned special adapter bricks. These matrix adapters are uniquely configured to position K'nex-compatible elements on a standard brick matrix in such a manner that the K'nex-compatible elements are spaced appropriately for incorporation into complex hybrid structures. The concepts of the invention enable this to be accomplished, using either "Classic" or "Micro" K'nex components or, in appropriate cases, both.

The objectives of the invention are accomplished by providing special matrix adapter elements with spaced apart stems, which are received in sockets in special Lego-compatible bricks or panels and extend upward therefrom. The spaced apart stems support an adapter rod in a generally horizontal orientation, with the axis of the adapter rod being offset laterally from the vertical axes of the stem elements. The extent of the lateral offset is such that by positioning the offset in one direction or the other, the otherwise incompatible dimensions of the brick system can be almost completely eliminated and, for practical purposes, ignored.

With different rod lengths of the K'nex components, spacing "errors" between the brick system and the K'nex system can vary, being positive in some cases and negative in others. This is readily accommodated in accordance with the invention, however, by the ability to reverse the orientation of the matrix adapters, such that the offset of the adapter rod adds or subtracts distance relative to the underlying sockets of the brick system as necessary to achieve substantial alignment. Accordingly, with a single adapter configuration (one for the "Classic" size and one for the "Micro" size), all of the otherwise incompatible spacings between the K'nex system and brick systems can be accommodated. Thus, with a few relatively simple components, it is possible to fully integrate a standard, preexisting Lego-type brick construction set with a standard, preexisting K'nex rod and connector construction set.

For a more complete understanding of the above and other features and advantages of the invention, reference should be made to the following detailed description of preferred embodiments thereof, and to the accompanying drawings.

DETAILED DESCRIPTION OF A PREFERRED EMBODIMENT

Figure 1A:
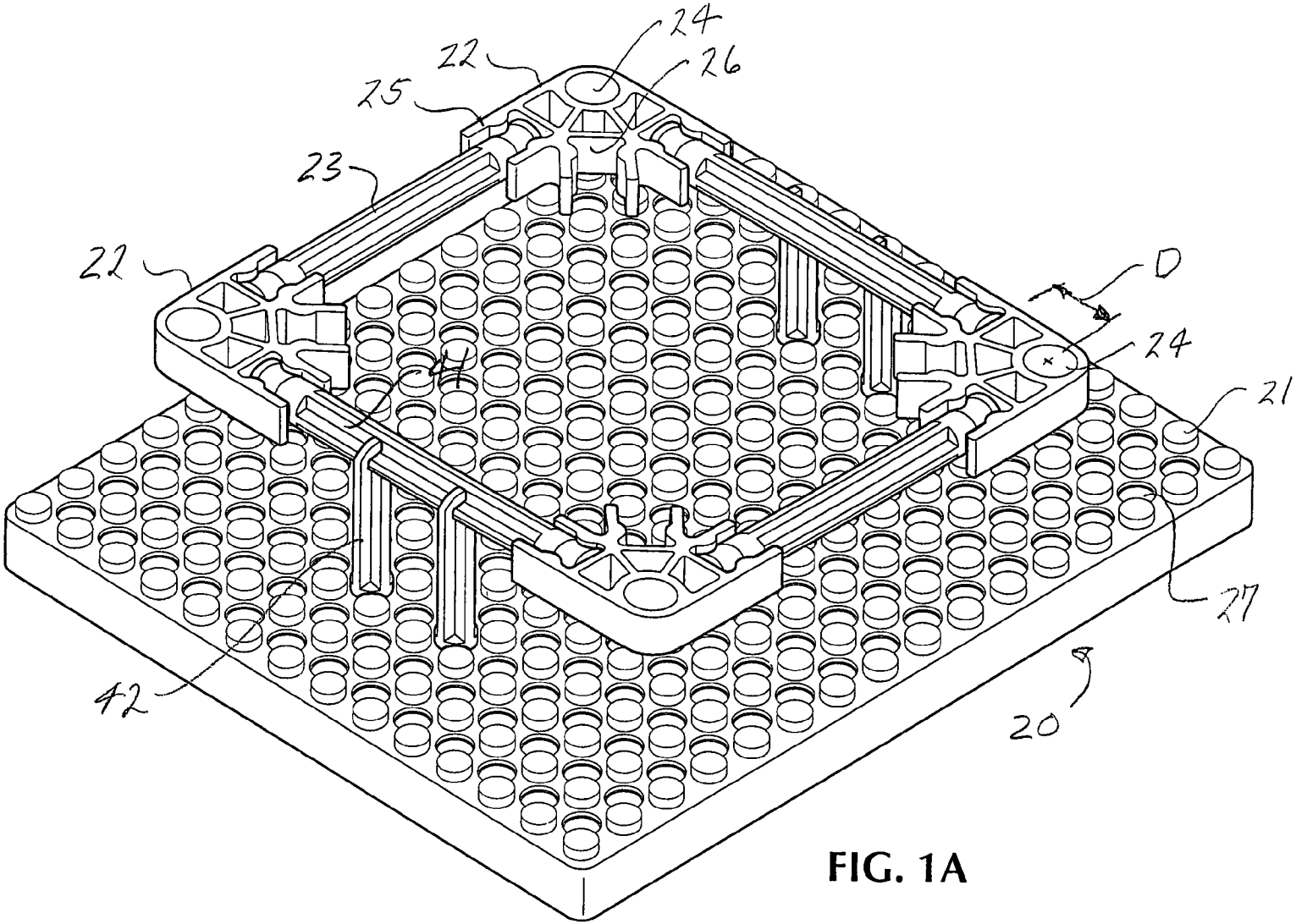
FIG. 1*a* is a perspective view illustrating a panel compatible with a Lego-type brick construction system, illustrated with assembled components from a "Classic" K'nex rod and connector system, and utilizing novel matrix adapter elements according to the invention.

Referring now to the drawing, and initially to FIG. 1*a*, the reference numeral 20 designates generally a mounting panel configured to be compatible with standard Lego-style brick construction toy systems. In this respect, the panel is provided over its working surface with a plurality of upwardly projecting cylindrical studs 21, which are spaced uniformly both longitudinally and laterally on the surface of the panel 20. In the standard Lego-style brick systems, the center-to-center spacing between adjacent projecting studs is approximately 0.315 inch (8.0 mm). As will appear hereinafter, the underlying support surface need not be an unbroken surface, such as the panel 20, but may be made up of individual bricks. Even with the bricks, however, the spacing matrix for the studs 21 will remain at 0.315 (8.00 mm). As can be well appreciated, the Lego-type brick construction systems have been on the market for many, many years and are sold not only by Lego but by others, such as Mega Bloks and Cobi Best-Lock. Accordingly, there is an enormous existing base of standard brick-type components, which have been sold over the years.

The K'nex rod and connector construction toy system is represented in FIG. 1*a* by connectors 22 and rods 23. Each of the connectors has a hub 24 with a central axis (not shown) and a plurality of rod-engaging sockets 25 extending radially from the axis of the hub 24 at 45° intervals. In each of the connectors 22 of the K'nex system, there is a fixed distance D from the center axis of the hub 24 to the base wall 26 of the socket 25. Thus, with any connector, of which there may be a variety, and with any socket of any connector, the distance from the hub axis to the base wall 26 is always a fixed distance D. In the case of the K'nex "Classic" construction set, that distance $D_c$ is 0.398 inch (10.1 mm).

As set forth in the beforementioned Glickman U.S. Pat. Nos. 5,061,219 and 5,199,919, the rods 23 of a K'nex set are provided in a particular progression of lengths according to the function $2D+L_x=0.707*(2D+L_{x+1})$. In existing K'nex "Classic" sets, the smallest rod has a length of 0.681 inch. When part of this length is joined with a connector at each end, the center line to center line distance between the hub axis of the respective connectors is 1.477 inch (37.5 mm). Based upon the aforementioned formula, the sequence of rod lengths in an existing K'nex "Classic" set are 0.681, 1.293, 2.158, 3.382, 5.112, and 7.559 inches (17.3, 32.8, 54.8, 85.9, 129.8, 192.0 mm). When any of these existing rod lengths are joined with connectors at each end, the geometry is such that very complex structures can be assembled.

To enable an interconnection between the Lego style brick system and the K'nex system, the panel 20 is provided over its working surface with a plurality of vertically disposed, cylindrical sockets 27. These sockets are centered among groups of the studs 21, such that the resulting center-to-center spacing between sockets is the same as that of the studs, namely 0.315 inch (8.0 mm) for a standard Lego-type system. However, none of the center line-center line distances between connectors attached at opposite ends of a rod 23 of any length in the foregoing progression agrees with the spacing of the studs 21 and sockets 27. In the underlying panel 20, for example, the centerline-to-centerline distance for the smallest "Classic" rod is 1.477 inch (37.5 mm), whereas the most closely matching centerline-to-centerline spacing between the sockets 27 in the panel are 1.26 inch (32.0 mm) on one side and 1.575 inch (40.0 mm) on the other. For a rod two sizes longer, the centerline-to-centerline distance between connector hubs is 2.954 inch (75.0 mm), whereas the most closely matching socket spacing on the underlying panel 20 is 2.835 inch (72.0 mm) on one side and 0.315 inch (8.0 mm) on the other. Similar misalignments occur for all sizes of rod and connector combinations, as is set forth in the Spacing Chart set forth hereinafter.

Figure 1B:
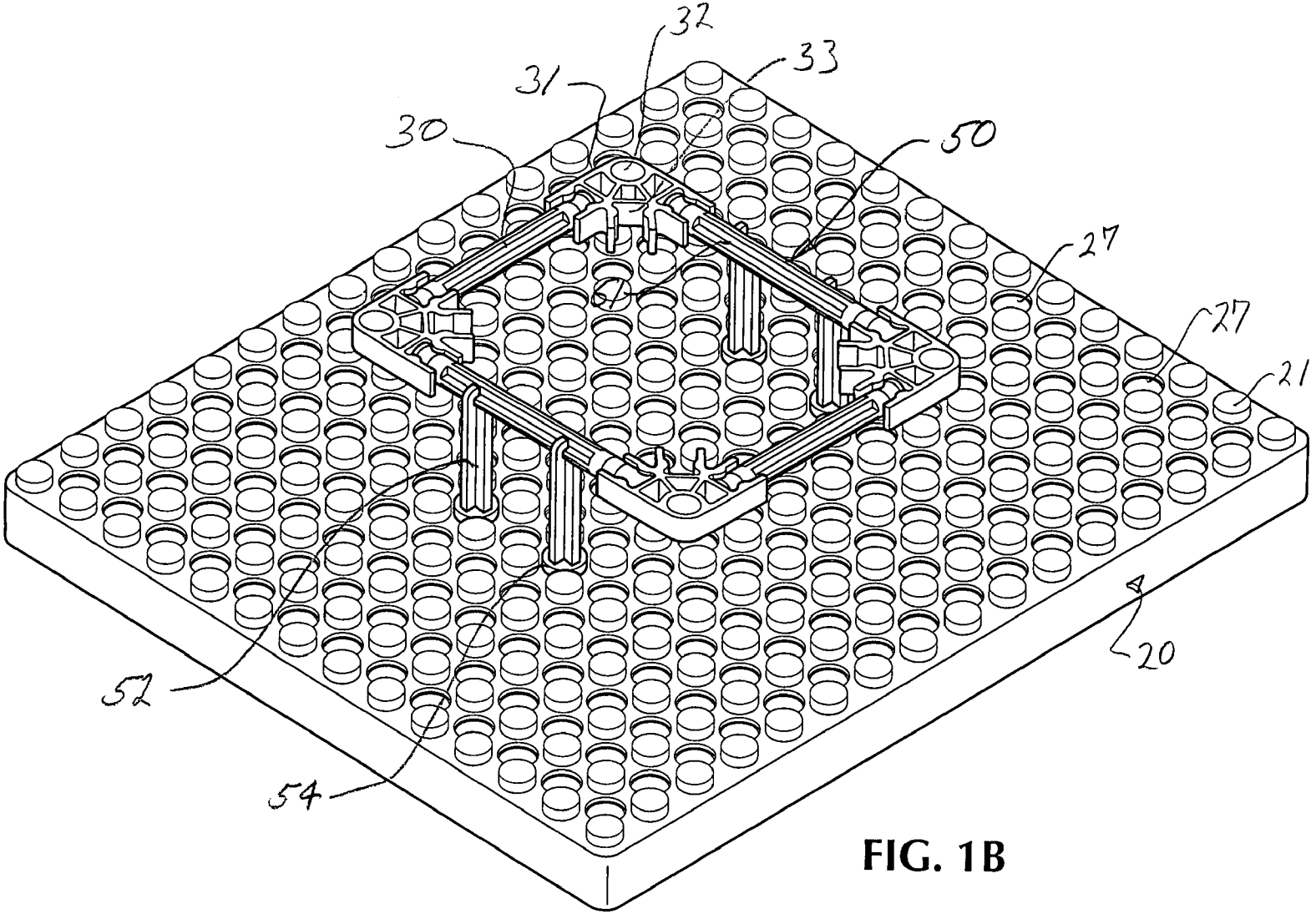
FIG. 1*b* is a perspective view, similar to FIG. 1*a*, illustrating a brick-compatible panel on which are mounted elements of a "Micro" K'nex rod and connector system.

FIG. 1*b* of the drawings shows a panel 20, which is the same as in FIG. 1*a*, with studs 21 and sockets 27 arranged on the same standard Lego-style spacing of 0.315 inch (8.0 mm). In the illustration of FIG. 1*b*, however, there is shown an illustrative assembly of existing K'nex "Micro" components, including rods 30 and connectors 31. As can be seen by comparison of FIGS. 1*a* and 1*b*, which are shown at the same scale, the "Micro" components are considerably smaller than the "Classic" components. Nevertheless, the progression of rod sizes for the "Micro" system follows the same formulation as for the "Classic" system, namely for "n" rod lengths, progressing from lengths $L_1$ to $L_n$, the length will increase as a function of $2D+L_x=0.707*(2D+L_{x+1})$. In the case of the "Micro" system, however, the distance "$D_n$" from the hub axis 32 of the connector to the base wall 33 of one of its sockets is 0.241 inch (6.12 mm). The shortest rod length $L_1$ for an existing "Micro" set is 0.5625 inch (14.3 mm), which, when joined with connectors at each end, provides a centerline-to-centerline distance between hub axes of 1.0445 inch (26.5 mm). To advantage, the length progression of the "Micro" rods is such that, commencing with rod lengths $L_2$ of the "Micro" set, the centerline-to-centerline distances between hub axes of the "Micro" set will correspond identically with the centerline-to-centerline distance of the "Classic" set. In all cases, however, such centerline-to-centerline distances do not coincide with the socket spacings in the underlying panel 20, which are dictated by standard Lego-style spacing matrixes.

Pursuant to the invention, compatibility between the existing K'nex construction sets ("Classic" or "Micro") and the standard Lego-style systems is achieved through the use of novel offset adapter elements, which are installed on the panel boards 20 and which can be oriented in either of two directions, one of which serves to substantially correct for the differentials existing between spacing of the panel sockets 27 and the spacing between hub axes of a pair of connectors attached to a K'nex rod, "Classic" or "Micro". Pursuant to the invention, a single type of offset matrix adapter, one for each system ("Classic" and "Micro") can be utilized in conjunction with any rod and connector combination to allow an assembly of such to be integrated with the panel 20. While minor spacing differences may remain, they are so small as to be insignificant in the structural assembly and unnoticeable to all but perhaps the most trained eye. For practical purposes they may be ignored.

With respect to FIGS. 3*a*-6*a* inclusive, there is shown an offset adapter according to the invention proportioned appropriately for use in conjunction with a K'nex "Classic" building system. The offset adapter, generally designated by the reference numeral 40 comprises an offset rod 41, which is integrally joined with a pair of adapter stems 42. Preferentially, the entire offset adapter 40 is a single piece injection molding of suitable structural plastic material. The stems 42, which may have an approximately ¼ inch (6.35 mm) transverse dimension, are provided at their lower ends with bifurcated extensions 43 defined at the top by a flange 44 and at the bottom by a detent bead 45. The spacing between axes of the respective stems 42 advantageously is equal to twice the standard spacing between studs 21 and sockets 27 on the panel 20 (i.e., 0.630 inch; 16.0 mm). Accordingly, the offset adapters may be mounted on the panel 20 by inserting the extensions 43 into a pair of spaced apart sockets 27.

Figure 7:
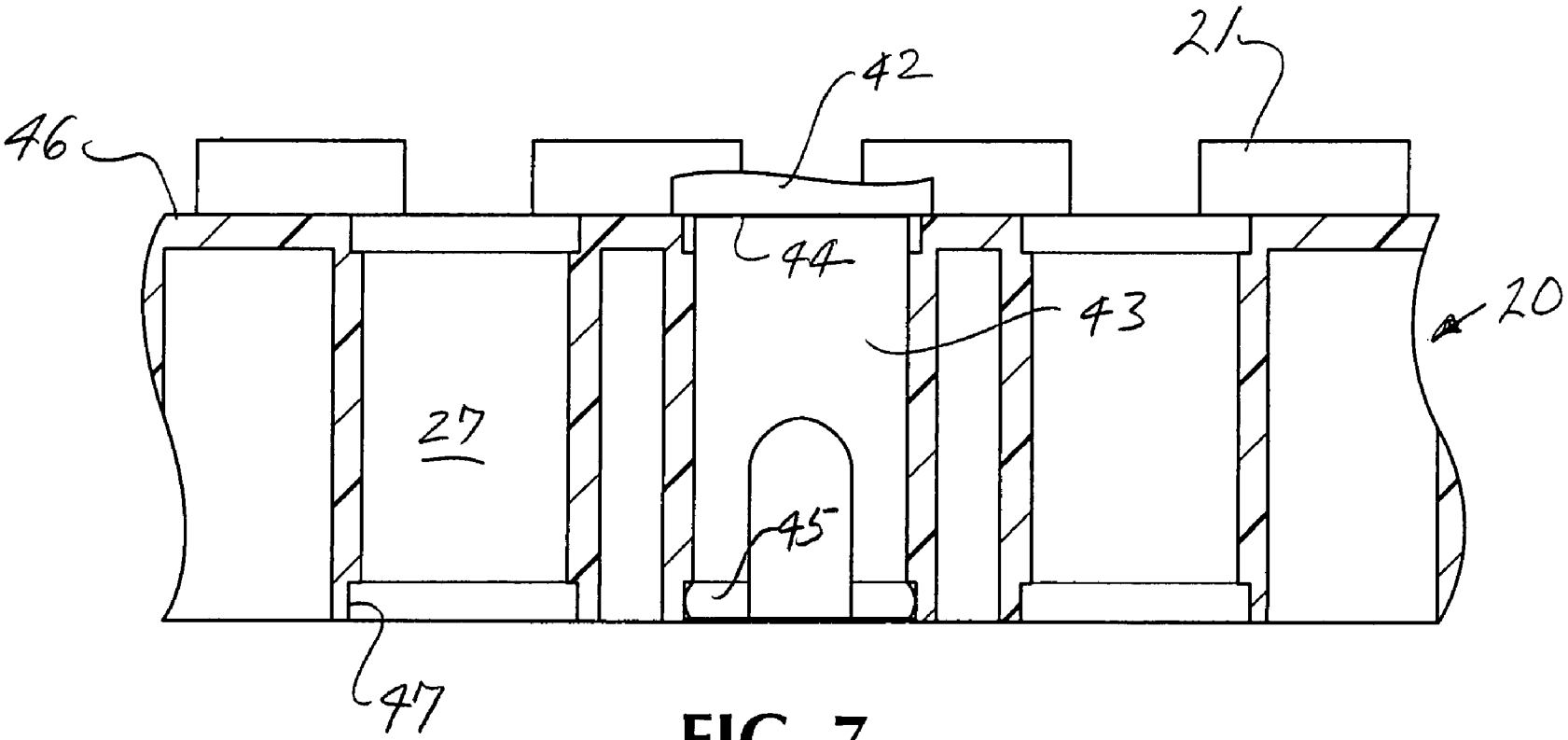
FIG. 7 is an enlarged, fragmentary cross sectional view illustrating one of the adapter stems installed in a special adapter brick element.

As shown in FIG. 7, the bifurcated extensions 43 are of generally the same diameter as the cylindrical sockets 27 and will fit snugly into the sockets until the flanges 44 engage the upper surface 46 of the panel 20. The detent bead 45 engages in a cylindrical recess 47 in the lower part of the cylindrical socket, such that the offset adapter snaps into a fixed position when its extensions 43 are inserted into the sockets 27. As shown in FIG. 1*a*, when installed on the panel 20, the stems 42 of the offset adapter will be generally vertical, and the offset rod 41 is generally horizontal. It will be understood that references herein to vertical and horizontal orientations are simply to facilitate understanding, as the elements may have different orientations in actual use.

In the illustrations of FIGS. 3*a*-6*a*, the offset rod element 41 is of a length of approximately 2.158 inch (54.8 mm), corresponding to length $L_3$ in a series of six rod lengths of a "Classic" set. Theoretically, a shorter rod length could be utilized with the "Classic" system. However, it is preferred to utilize two mounting stems 42 and to space those stems apart a distance equal to two socket spacings on the panel 20. For these preferential conditions to be realized, the $L_3$ rod length is appropriate to provide space at the ends for assembly with connector elements.

Figure 2A:
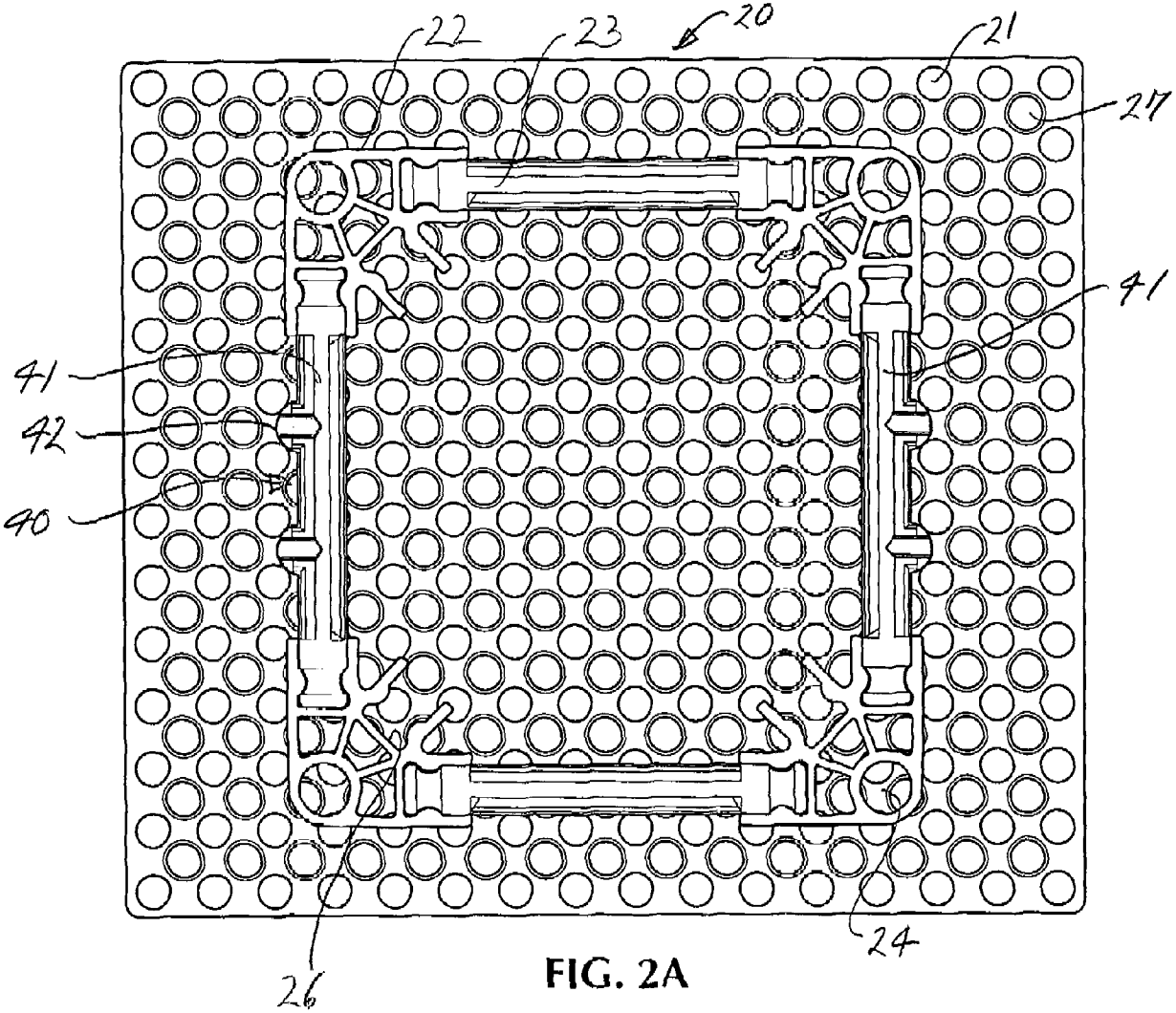
FIG. 2*a* is a top plan view of the assembly of FIG. 1*a*.
Figure 2B:
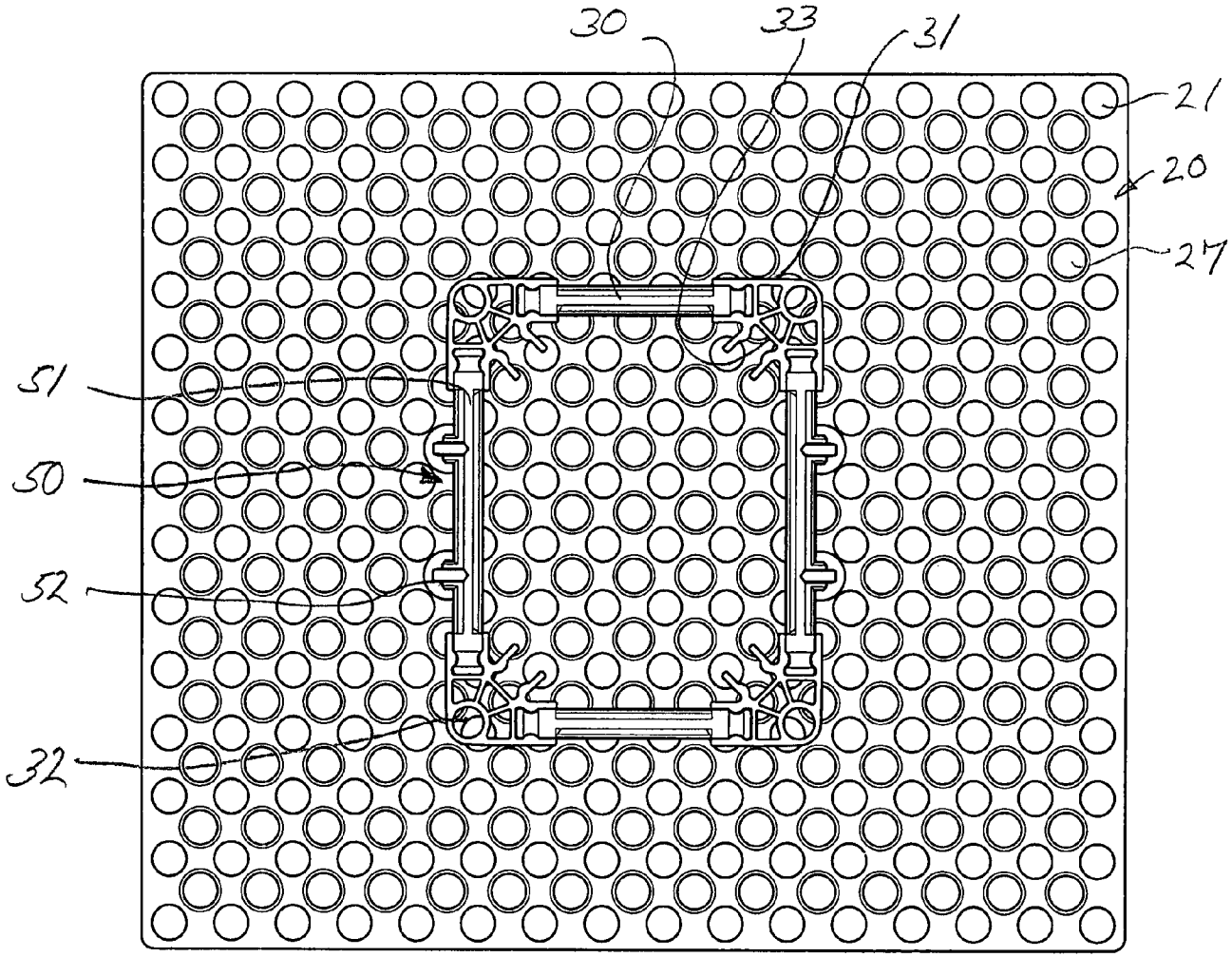
FIG. 2*b* is a top plan view of the assembly of FIG. 1*b*.
Figure 3B:
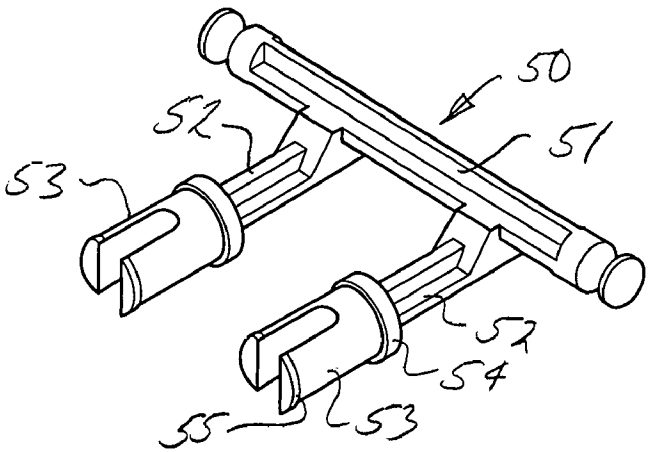
FIGS. 3*a* and 3*b* are perspective views of matrix adapter elements according to the invention sized respectively for K'nex "Classic" and "Micro" rod and connector systems.
Figure 3A:
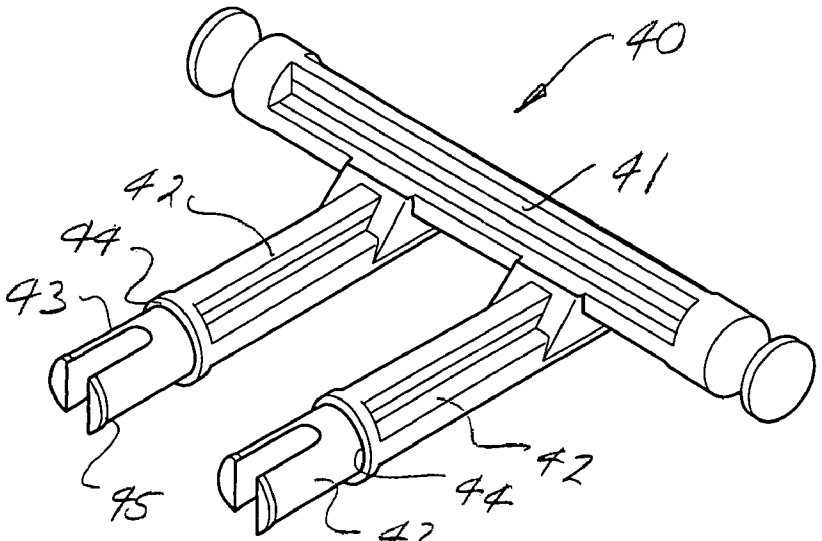
Figure 4B:
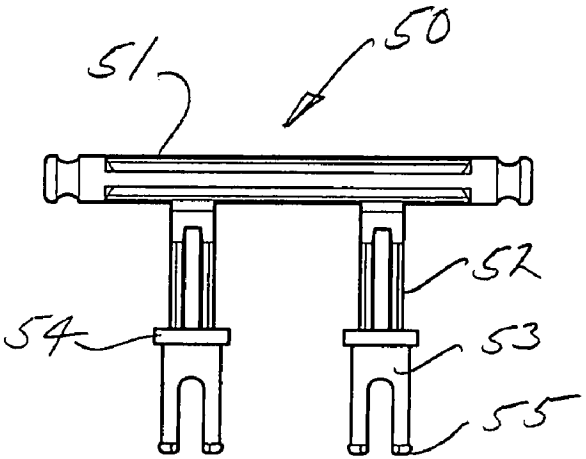
FIGS. 4*a* and 4*b* are front elevational views of the matrix adapter elements of FIGS. 3*a* and 3*b* respectively.
Figure 4A:
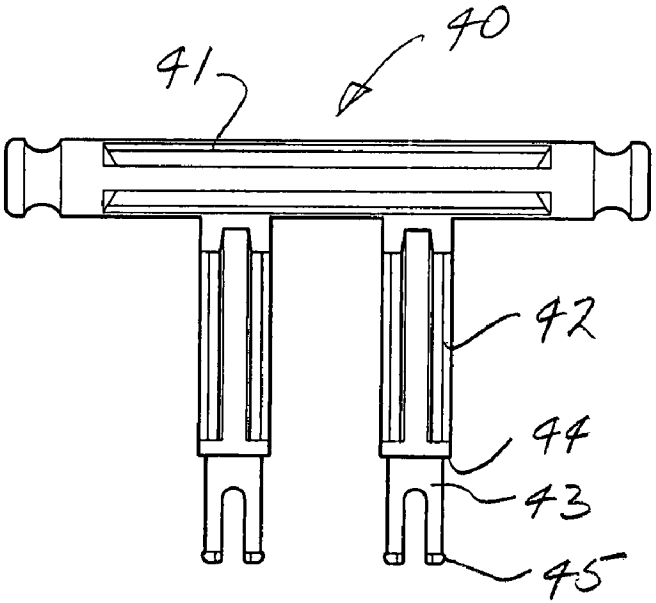
Figure 5B:
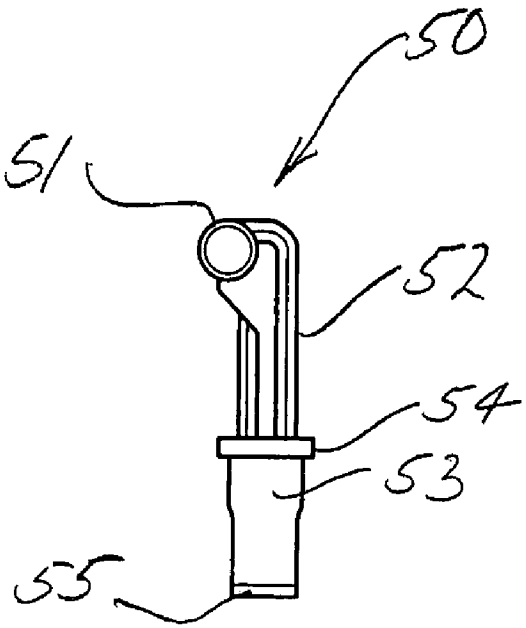
FIGS. 5*a* and 5*b* are end elevational views of the respective matrix adapters.
Figure 5A:
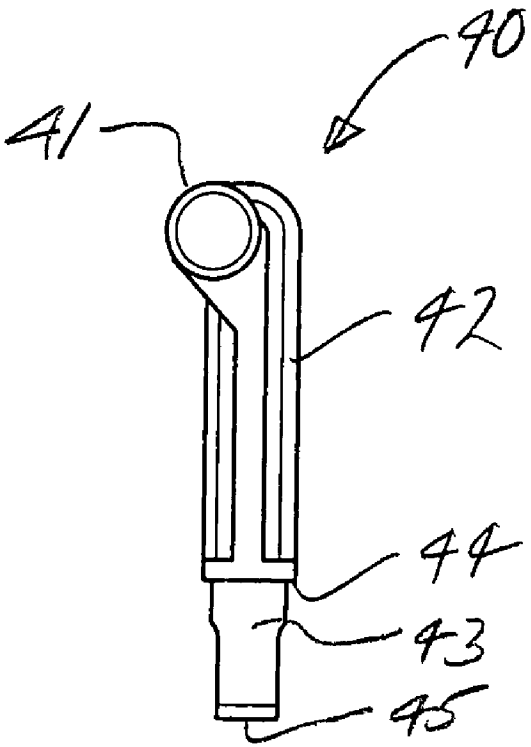
Figure 6B:
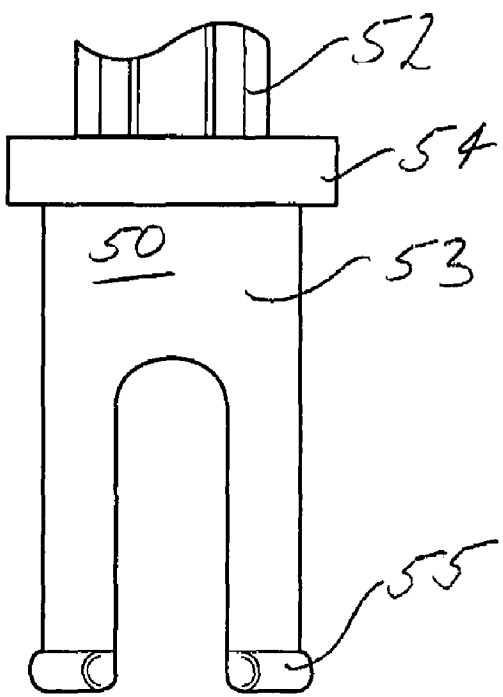
FIGS. 6*a* and 6*b* are enlarged fragmentary elevational views showing details of the lower end portions of stem portions of the respective matrix adapters.
Figure 6A:
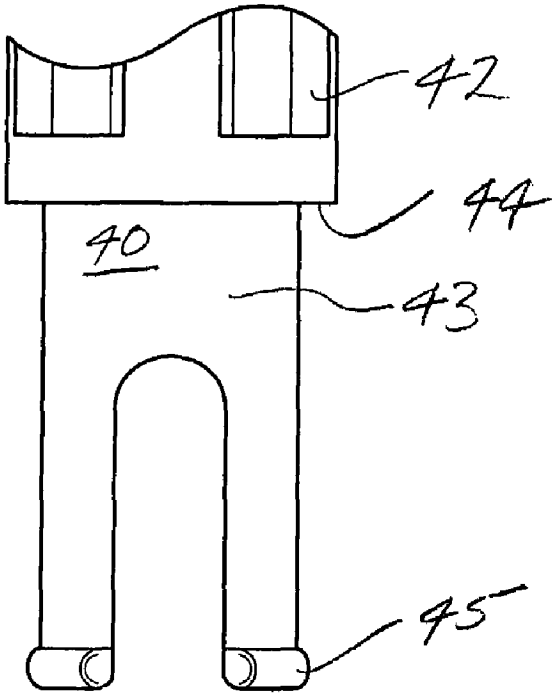

For the "Micro" system, shown in FIGS. 3*b*-6*b*, an offset adapter 50 is provided, consisting of a "Micro"-sized offset rod 51 and spaced apart "Micro"-sized mounting stems 52. The transverse dimensions of the offset rod 51 and stems 52 may be approximately 0.152 inch (3.86 mm), as compared to about ¼ inch (6.35 mm) for the corresponding elements of the "Classic" system. Desirably and advantageously, the mounting stems 52 are spaced apart the same for the "Micro" adapter 50 as for the "Classic" adapter 40, namely on a center-to-center distance equal to the spacing of two sockets 27 on the panel 20. At the lower end of each of the mounting stems 52, is an extension 53, defined at the top by a flange 54 and at the bottom by a detent bead 55. The dimensions of the extensions 53 and related components are basically the same for the "Micro" adapter 50 as for the "Classic" adapter 40, inasmuch as in each case the extensions are intended for insertion in the standard sockets 27 of the mounting panel 20. Because of the smaller dimensions of the "Micro" connectors, the lengths of the offset rods 51 may be less than for the "Classic" offset rod 41, for example about 1.607 inch (40.8 mm), which corresponds to a "Micro" rod length $L_3$ in a series progression according to the before stated formula. As is evident in FIGS. 1*b* and 2*b*, the "Micro" offset adapters 50 are mounted on the panel 20 in the same manner as the offset adapters 40 for the "Classic" system.

Pursuant to one aspect of the invention, the offset rods 41, 51 are arranged with their respective axes offset approximately 0.104 inch (2.64 mm) from the vertical axes of the stems 42, 52 on which they are mounted. This offset distance corresponds to approximately one third of the 0.315 inch (8.00 mm) spacing of the adapter sockets 27.

As illustrated in FIGS. 1*a* and 1*b*, the offset adapters 40, 50 are installed in the panels 20 in such manner that their respective offset rods 41, 51 are offset toward each other from their respective mounting stems 42, 52. Thus, the spacing between the respective offset rods 51 of a spaced pair thereof is 0.208 inches (5.52 mm) less than the spacing between the sockets 27 in which the mounting stems 42, 52 are inserted. If the offset adapters 40, 50 are reversed, that is positioned with their offset rods 41, 51 offset toward the outside (not shown in the illustrations), rather than the inside, the spacing between the respective offset rods 41, 51 is greater than the spacing between the sockets in which the mounting stems 42, 52 are inserted.

With reference to the Spacing Chart below, it can be seen that, with the indicated 0.104 inch offset of the rods 41, 51, the spacing differences between the K'nex and Lego systems can be substantially eliminated, to the point where remaining differences can be simply ignored. For example, with the smallest "Micro" rod, the centerline-to-centerline distance between connectors 22 mounted at each end thereof is 1.0445 inch (corresponding millimeter dimensions are noted in the lower portion of the Spacing Chart). In the Lego matrix, however, there is no corresponding socket spacing. The nearest socket spacings are 1.26 inch (which is larger) and 0.945 (which is smaller). In the system of the invention, however, a pair of matrix adapter elements 50 can be installed in sockets spaced 1.26 inches apart, with the offset rods 51 being offset toward each other, as shown in FIG. 1*b*. This will position the axes of the respective offset rods 51 at a spacing of 1.052 inches, differing from perfection (1.0445) by a distance of less than 0.004 inch at each side, small enough to be ignored. Thus, the structure fully integrates into the K'nex system, enabling a complete variety of K'nex structures to be assembled and integrated with a wide variety of Lego-type brick components.

each other. The resulting centerline-to-centerline spacing between the rods 41 or 51 is 1.468 inch (differing from perfection by an amount less than 5 one-thousandths of an inch at each side, which can be ignored).

As can be ascertained by perusing the remainder of the spacing chart, by orienting the adapters 40, 50 with their offsets either facing outwardly or inwardly, the spacing differences between the Lego matrix and the K'nex rod and connector system can be substantially eliminated. For centerline-to-centerline distances of up to about three inches, the uncorrected spacing differential is 6 one-thousandths of an inch or less at each side. For the larger spacings of the K'nex system (4.178, 5.909, 8.356) uncorrected differentials are 12, 15.5 and 21 one-thousandths, respectively at each side, which are insignificant in relation to the rod lengths to which they apply.

Thus, it will be appreciated that, with essentially a single type of matrix adapter part (one for the K'nex "Classic" system and one for the "Micro" system), almost seamless integration between the K'nex system and the Lego-type systems can be accomplished.

SPACING CHART

| Centerline to Centerline Distance | Closest Socket Spacing Greater/Less | Difference | Offset Distance To Inside | Offset Distance To Outside | Spacing After Offset | Offset Differential Each Side |
|---|---|---|---|---|---|---|
| (Inches) | (Inches) | (Inches) | (Inches) | (Inches) | (Inches) | (Inches) |
| 1.0445 | 1.26 | 0.2155 | 0.208 | | 1.052 | 0.00375 |
| | 0.945 | −0.0995 | | | | |
| 1.477 | 1.575 | 0.098 | | | | |
| | 1.26 | −0.217 | | 0.208 | 1.468 | −0.0045 |
| 2.089 | 2.205 | 0.116 | | | | |
| | 1.89 | −0.199 | | 0.208 | 2.098 | 0.0045 |
| 2.954 | 3.15 | 0.196 | 0.208 | | 2.942 | −0.006 |
| | 2.835 | −0.119 | | | | |
| 4.178 | 4.41 | 0.232 | 0.208 | | 4.202 | 0.012 |
| | 4.095 | −0.083 | | | | |
| 5.909 | 5.984 | 0.075 | | | | |
| | 5.67 | −0.239 | | 0.208 | 5.878 | −0.0155 |
| 8.356 | 8.509 | 0.153 | | | | |
| | 8.19 | −0.166 | | 0.208 | 8.398 | 0.021 |
| (Millimeters) | (Millimeters) | (Millimeters) | (Millimeters) | (Millimeters) | (Millimeters) | (Millimeters) |
| 26.53 | 33.43 | 6.90 | 5.52 | | 27.91 | 0.69 |
| | 25.07 | −1.46 | | | | |
| 39.19 | 41.79 | 2.60 | | | | |
| | 33.43 | −5.76 | | 5.52 | 38.95 | −0.12 |
| 55.42 | 58.50 | 3.08 | | | | |
| | 50.14 | −5.28 | | 5.52 | 55.66 | 0.12 |
| 78.37 | 83.57 | 5.20 | 5.52 | | 78.05 | −0.16 |
| | 75.21 | −3.16 | | | | |
| 110.84 | 117.00 | 6.16 | 5.52 | | 111.48 | 0.32 |
| | 108.64 | −2.20 | | | | |
| 156.77 | 158.76 | 1.99 | | | | |
| | 150.43 | −6.34 | | 5.52 | 155.95 | −0.41 |
| 221.69 | 225.75 | 4.06 | | | | |
| | 217.28 | −4.40 | | 5.52 | 222.80 | 0.56 |

Figure 8:
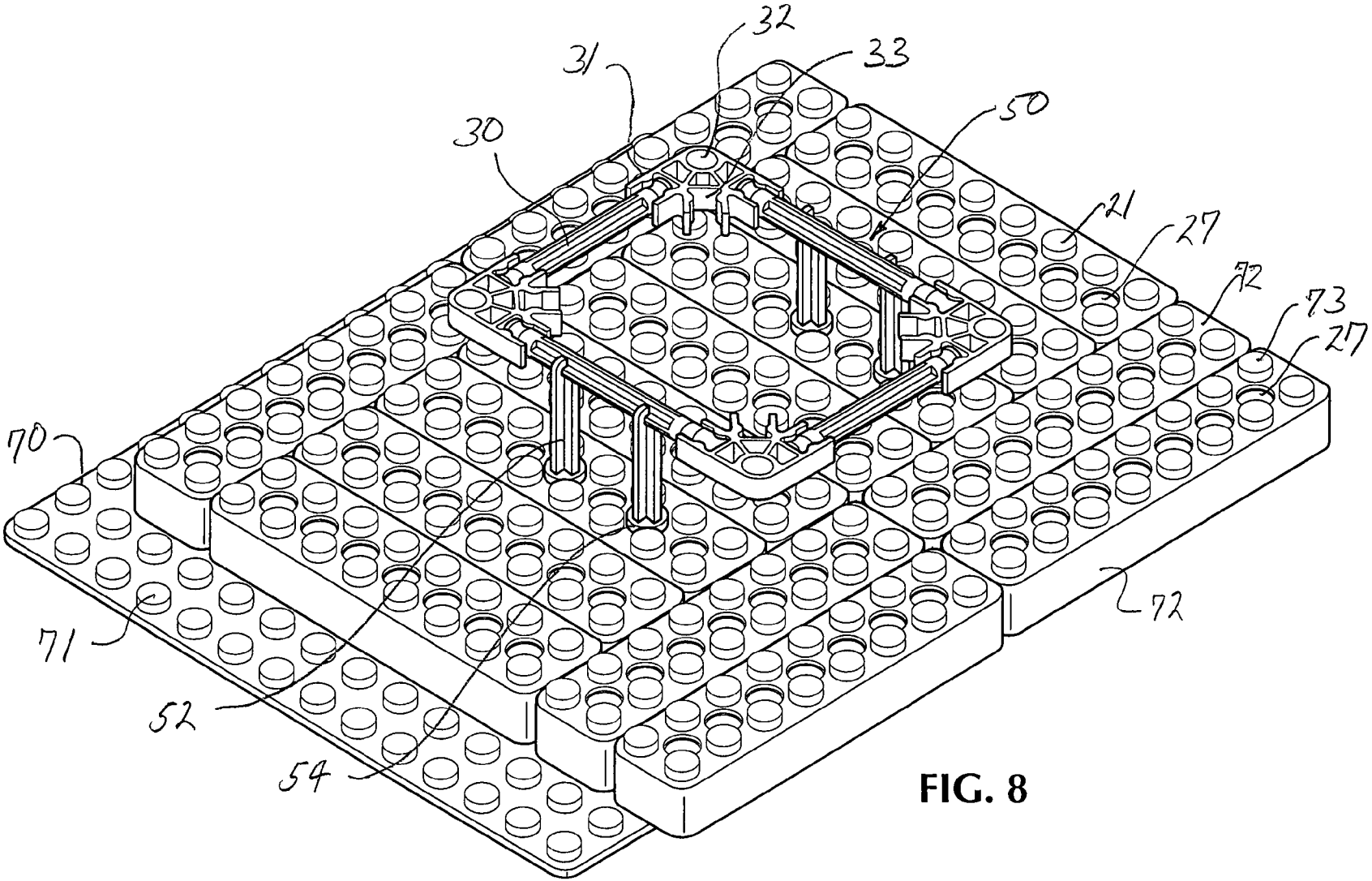
FIG. 8 is a perspective view, similar to FIGS. 1*a* and 1*b*, illustrating a base structure comprised of a plurality of individual bricks rather than a unitary panel.

For the next larger size of K'nex rod in the progression, for which the center-to-center distance between connectors is 1.477 inch, the closest socket spacings in the Lego matrix are 1.575 inch and 1.26 inch. For this rod size, the adapters 40 or 50 are inserted in sockets spaced apart by 1.26 inch, and are oriented with their rods 41, 51 offset to the outside, away from With reference to FIG. 8, a base matrix is illustrated which is constructed by a series of bricks, which are assembled together, to form a matrix similar to that of the panels 20 of FIGS. 1*a* and 1*b*. However, when the base matrix is formed of a brick assembly, there are fewer sockets in the surface of the base. In the arrangement of FIG. 8, there is a relatively thin, flat base panel 70 provided over its entire surface with upwardly projecting cylindrical studs 71. A plurality of bricks 72 are mounted on the base panel 70 in the customary manner for assembling Lego-style elements. In the illustrated arrangement, however, the bricks 72, which are of a 2×8 configuration, are each provided with a series of adapter sockets 27, positioned symmetrically between each group of four studs 73 of the bricks.

Along the length of the bricks 72, the adapter sockets 27 are spaced apart with the standard Lego-style matrix, namely 0.315 inch (8.0 mm) spacing. However, as will be observed by comparison of FIG. 1*a* with FIG. 8, where adjacent bricks 72 abut one another, whether side-by-side, end-to-end, or end-to-side, there are "missing" adapter socket spaces where the bricks abut. However, the geometry of the bricks is such that side and end walls are spaced from the nearest adjacent adapter socket by a distance, 0.315 inch (8.0 mm) which is consistent with the spacing matrix. Accordingly, between two adjacent bricks, abutted wall-to-wall, the spacing between the closest pair of adapter sockets 27 in adjacent bricks, is twice the standard spacing, or 0.630 inch (16.0 mm). In the arrangement of FIG. 8, where the bricks are mounted in a compact configuration, with no space between adjacent bricks, all of the adapter sockets 27 are positioned either one or two standard spacings "C" from the nearest adjacent socket. Accordingly, in the preferred and illustrated form of the invention, the mounting stems 42, 52 for both the "Classic" and "Micro" offset adapters are spaced apart a distance of two standard spacings "C" or 0.630 inch (16.0 mm). This enables the matrix adapters to extend over two adjacent bricks, if necessary.

In an assembly such as illustrated in FIG. 8, wherein the base is formed of individual bricks, there may be open spaces between some of the bricks. However, it is always possible to place bricks where necessary in order to receive mounting stems for the matrix adapters. Typically, there will be a substantial plurality of adapter sockets spaced no farther apart than two times the standard spacing "C", and additional bricks can be added if necessary, so that mounting locations for the matrix adapters will not be an issue.

With the system of the invention, it becomes possible to integrate the large existing customer bases of Lego-style components with the large existing bases of K'nex system components, so that the two systems can be easily integrated for the assembly of unique hybrid structures. With the improvements of the invention, pairs of simple, inexpensive offset matrix adapter elements, installed in Lego-style base structures enable differences in the spacing matrixes of the two systems to be effectively offset, to a level where the differences are insignificant and do not interfere with the complete integration of the two systems.

In the illustrations of this application, it is assumed that K'nex components are being integrated with Lego-style base structure. However, the matrix adaptation works both ways, in that the matrix adapters may be installed in a parent K'nex structure, so that a brick-based structure can be integrated therewith. The invention thus vastly improves the usefulness of both existing systems, K'nex and Lego-style, such that the customer has enormously greater freedom to design and build complicated hybrid structures using standard components from both systems.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. An offset matrix system for the structural integration of a rod and connector construction toy set with a brick-type construction set, where (a) the rod and connector set includes a plurality of shapes and sizes of connectors, each having a hub and a plurality of rod-engaging sockets disposed radially with respect to a longitudinal axis of the hub, with said sockets having base walls spaced a uniform distance "D" from the hub axis, and with the rods being provided in a progression of lengths $L_1 \ldots L_n$, increasing as a function of $2D+L_x=0.707*(2D+L_{x+1})$, where D alternatively is approximately 0.398 inch or 0.241 inch, and where one of the lengths $L_x$ is approximately 1.477 inch and where said rods are formed with opposite rod ends including an end flange and an adjacent neck portion of reduced diameter adapted for lateral snap-in assembly with a connector socket, (b) said brick-type construction set includes one or more brick-type construction elements forming a matrix of upwardly projecting studs spaced apart on a consistent basis longitudinally and transversely at a center-to-center spacing "C" of approximately 0.315 inch, (c) said brick-type construction elements being formed with a plurality of vertically oriented adapter sockets positioned centrally between sets of four studs, such that all of the adapter sockets are spaced longitudinally and laterally from each other at a distance of approximately C*S center to center, where S is a positive integer greater than zero, (d) a plurality of said adapter sockets being spaced apart a distance no greater than 2*C from the nearest adjacent adapter socket, which comprises (e) a plurality of matrix adapter elements engageable with said adapter sockets, (f) each matrix adapter element being a unitary molding of plastic material and comprising a pair of spaced-apart, vertically oriented mounting stems having free end portions shaped and sized for a close fit axially into a pair of adapter sockets, and a horizontally oriented offset rod integrally joined with upper ends of said mounting stems, (g) said free end portions of said mounting stems having vertical axes spaced apart a distance of $C*S_1$, where $S_1$ is a positive integer greater than zero, (h) said offset rod being of a length according to the before mentioned progression $L_1 \ldots L_n$, and having at opposite end portions thereof rod ends each including an end flange and an adjacent neck portion of reduced diameter, (i) said mounting stems being integrally joined in upper portions thereof with intermediate portions of said offset rod, such that end portions of said offset rod extend beyond said mounting stems on both sides sufficiently to enable connections with a connector element at each end, (j) said offset rod having a rod axis and said rod axis being offset laterally from the axes of said free end portions by a distance "O" which is less than the spacing distance C, whereby in an assembly of rod and connector elements and brick-type construction elements, an opposed pair of said matrix adapters are inserted in spaced-apart pairs of adapter sockets, with the offset orientation of each matrix adapter of an opposed pair thereof being a mirror image of the opposing matrix adapter, such that the offset rods of both matrix adapters are positioned in parallel relation and alternatively will be spaced closer together than the free end portions of the opposed pairs of mounting stems or farther apart than the opposed pairs of mounting stems by a distance equal to 2*O, such that the respective rod ends of the offset rods are spaced apart a distance closely approximating a distance $2D+L_x$, to enable other rod and connector assemblies and subassemblies to be joined with said matrix adapters.

2. An offset matrix system according to claim 1, wherein (a) said offset distance "O" is equal to approximately one third of the spacing "C".

3. An offset matrix system according to claim 1, wherein (a) the free end portions of said mounting stems are positioned in a fixed, parallel arrangement spaced apart by a distance equal to 2*C, and (b) said offset rod integrally joined with said mounting stems at upper extremities thereof and oriented at right angles to said mounting stems.

4. An offset matrix system according to claim 3, wherein (a) said matrix adapter elements are configured for K'nex rod and connector systems to two basic sizes, larger and smaller, (b) the smaller of said systems utilizing rod-and-connector length progression corresponding to the larger system, with each being smaller by a factor of approximately 0.707, and (c) the offset rod of the matrix adapter for the smaller system being correspondingly shorter than the offset rod of the matrix adapter for the larger system, and (d) the free end portions of the mounting stems for the matrix adapter elements of both the larger and smaller systems being spaced apart the same distance to accommodate insertion in adapter sockets of a common brick-type construction element.

5. An offset matrix system for the structural integration of a rod and connector construction toy set with a brick-type construction set, where (a) the rod and connector set includes a plurality of shapes and sizes of connectors, each having a hub and a plurality of rod-engaging sockets disposed radially with respect to a longitudinal axis of the hub, with said sockets having base walls spaced a uniform distance "D" from the hub axis, and with the rods being provided in a progression of lengths $L_1 \ldots L_n$, increasing as a function of $2D+L_x=0.707*(2D+L_{x+1})$, where D is a fixed dimension and where the shortest rod has a length $L_1$ which is equal to or greater than 2*D, and where said rods are formed with opposite rod ends including an end flange and an adjacent neck portion of reduced diameter adapted for lateral snap-in assembly with a connector socket, (b) said brick-type construction set includes one or more brick-type construction elements forming a matrix of upwardly projecting studs spaced apart on a consistent basis longitudinally and transversely at a center-to-center spacing "C", (c) said brick-type construction elements being formed with a plurality vertically oriented adapter sockets positioned centrally between sets of four studs, such that all of the adapter sockets are spaced longitudinally and laterally from each other at a distance of approximately C*S center to center, where S is a positive integer greater than zero, which comprises (d) a plurality of said adapter sockets being spaced apart a distance no greater than 2*C from the nearest adjacent adapter socket, (e) a plurality of matrix adapter elements engageable with said adapter sockets, (f) each matrix adapter element being of one-piece construction and comprising a pair of spaced-apart, vertically oriented mounting stems having free end portions shaped and sized for a close fit axially into a pair of adapter sockets, and a horizontally oriented offset rod integrally joined with upper ends of said mounting stems, (g) the free end portions of said mounting stems having vertical axes spaced apart a distance of $C*S_1$, where $S_1$ is a positive integer greater than zero, (h) said offset rod being of a length according to the before mentioned progression $L_1 \ldots L_n$, and having at opposite end portions thereof rod ends each including an end flange and an adjacent neck portion of reduced diameter, (i) said mounting stems being integrally joined in upper portions thereof with intermediate portions of said offset rod, such that end portions of said offset rod extend beyond said mounting stems on both sides sufficiently to enable connections with a connector element at each end, (j) said offset rod having a rod axis and said rod axis being offset laterally from the axes of the free end portions of said mounting stems by a distance "O" which is less than the spacing distance C, whereby in an assembly of rod and connector elements and brick-type construction elements, an opposed pair of said matrix adapters are inserted in spaced-apart pairs of adapter sockets, with the offset rods thereof positioned in parallel relation and offset alternatively inwardly or outwardly with respect to the opposed matrix adapter of the pair, such that the respective rod ends of a pair of offset rods are spaced apart a distance either greater than or less than the spacing of the free end portions of said mounting stems by an amount equal to 2*O, which spaced apart distance closely approximates a distance $2D+L_x$, to enable other rod and connector assemblies and subassemblies to be joined with said matrix adapters.

6. An offset matrix system according to claim 5, wherein (a) said offset distance "O" is approximately one-third the spacing distance C.

7. An offset matrix system according to claim 1, wherein (a) the offset rods of said matrix adapters have a transverse dimension, and (b) the amount of offset between the rod axes of said offset rods and the axes of the free ends of the mounting stems to which they are joined is less than said transverse dimension.

8. An offset matrix system according to claim 5, wherein (a) the offset rods of said matrix adapters have a transverse dimension, and (b) the amount of offset between the rod axes of said offset rods and the axes of the free ends of the mounting stems to which they are joined is less than said transverse dimension.

* * * * *